US010737877B2

(12) United States Patent
Treat

(10) Patent No.: US 10,737,877 B2
(45) Date of Patent: Aug. 11, 2020

(54) EXTERNALLY CONTROLLED RETROFITTABLE AERATOR CONTROL MODULE AND BLAST AERATOR EQUIPPED THEREWITH

(71) Applicant: Global Manufacturing Inc., Little Rock, AR (US)

(72) Inventor: Rodney D. Treat, Benton, AR (US)

(73) Assignee: Global Manufacturing Inc., Little Rock, AR (US)

( * ) Notice: Subject to any disclaimer, the term of this patent is extended or adjusted under 35 U.S.C. 154(b) by 0 days.

(21) Appl. No.: 16/380,322

(22) Filed: Apr. 10, 2019

(65) Prior Publication Data

US 2019/0329970 A1 Oct. 31, 2019

Related U.S. Application Data

(60) Provisional application No. 62/664,492, filed on Apr. 30, 2018.

(51) Int. Cl.
*B65D 88/70* (2006.01)

(52) U.S. Cl.
CPC ..... *B65D 88/703* (2013.01)

(58) Field of Classification Search
CPC ..... B65D 88/703
See application file for complete search history.

(56) References Cited

U.S. PATENT DOCUMENTS

| | | | | |
|---|---|---|---|---|
| 3,788,527 | A * | 1/1974 | Matson | B65D 88/703 222/195 |
| 3,915,339 | A * | 10/1975 | Matson | B65D 88/703 222/3 |
| 4,197,966 | A * | 4/1980 | Wadensten | B65D 88/703 222/1 |
| 4,469,247 | A | 9/1984 | Tompkins | |
| 4,496,076 | A | 1/1985 | Tompkins | |
| 4,703,869 | A * | 11/1987 | De Rooy | B65D 88/703 222/3 |
| 4,767,024 | A * | 8/1988 | Rappen | B65D 88/703 222/195 |
| 6,321,939 | B1 | 11/2001 | Treat | |
| 6,726,059 | B2 | 4/2004 | Treat | |
| 6,702,248 | B2 | 5/2004 | Treat | |

(Continued)

*Primary Examiner* — Jeremy Carroll
(74) *Attorney, Agent, or Firm* — Stephen D. Carver

(57) ABSTRACT

A blast aerator (20) having a discharge end (23) connected internally to a rigid output tube (24) includes a retrofittable aerator control module (15) that internally, sealingly interacts with the output tube (24). A tank discharge pipe (28) directs air blasts into an external application. The aerator control module (15) comprises an external actuator (30) that controls a reciprocating plunger assembly (50) that interacts with an internal plunger seat (77) to block or unblock air discharge. The plunger seat adaptor assembly (70) fitted to the aerator output tube (24) comprises a resilient plunger seat (77), that is blocked or unblocked by a plunger element (52) controlled by a slidable piston (38) that is pneumatically displaceable between tank-filling and tank discharge positions within the actuator (30). The plunger seat adaptor assembly (70) mechanically compensates for output tube misalignment to insure proper sealing. Operational air pathways pneumatically control piston movements without springs.

20 Claims, 17 Drawing Sheets

(56) References Cited

U.S. PATENT DOCUMENTS

| | | | | |
|---|---|---|---|---|
| 7,837,062 | B2 | 11/2010 | Pronschinske | |
| 2003/0132242 | A1* | 7/2003 | Treat | B65D 88/703 222/4 |
| 2007/0209648 | A1* | 9/2007 | Pronschinske | B65D 88/703 124/71 |

* cited by examiner

EXTERNALLY CONTROLLED RETROFITTABLE AERATOR CONTROL MODULE AND BLAST AERATOR EQUIPPED THEREWITH

CROSS REFERENCE TO RELATED APPLICATION

This application is based upon, and claims priority from prior U.S. Provisional Application Ser. No. 62/664,492, filed 30 Apr. 2018, which was entitled "Blast Aerator with Plunger Valve Controlled by an External Actuator", by inventor Rodney D. Treat (American Citizen).

BACKGROUND OF THE INVENTION

I. Field of the Invention

The present invention relates generally to industrial air cannons or blast aerators and their replacement parts. More particularly, the present invention relates to blast aerators with an input end mounting a modularized, piston equipped control system for activation of an internal air discharge pathway that provides blast outputs.

II. Description of the Prior Art

Modern industrial blast aerators, which are sometimes called "air cannons" or "air blasters", typically comprise a compressed air reservoir with a quick-opening valve that periodically releases stored air in a sudden, high-energy blast. Blast aerators are used by numerous industries to facilitate material flow. The blast aerator's powerful air discharge is directed through an output pathway comprising a pipe or the like to aerate and dislodge bulk material, and restore flow in bins, hoppers, silos, rotary kilns, etc. Current blast aerator designs date back to the early 1980's.

Various prior art designs that have been previously manufactured and employed typically share similar characteristics. For example, all known aerator designs comprise a rigid tank with a rigid, internal tube that connects an air supply port to a spaced-apart discharge port. Usually a quick opening valve mounted within or upon the tube allows air stored in the tank to suddenly and quickly re-enter the tube so it can exit the discharge port. In each case the valve utilizes a disc or piston that opens and closes the path for air blast discharge. For example, this piston or disc may be controlled by air pressure applied to each side of the disc. When the pressure on the air supply side of the disc is greater than the pressure on the discharge side of the disc, the disc closes off the path to the discharge port. If the pressure on the air supply side of the disc is reduced, the pressure in the tank pushes the disc or piston back, allowing the air in the tank to escape through the path to the discharge port.

Typical blast aerator designs vary in construction. For example, the location of the quick opening valve in one common configuration is near the discharge port. This allows the tube connecting the air supply port to the valve to be smaller in diameter, since its function is to supply air to fill the reservoir and to draw air out from the air supply side of the disc to trigger the valve to open and fire the air cannon. This type of design maximizes the volume of the tank because the small fill line uses little of the space inside the tank. A significant disadvantage is that the entire air cannon has to be removed from its mount to service the valve components. To overcome this disadvantage, external valves were developed.

In external valve designs a tube still connects the air supply port to the discharge port with the valve in the middle, but the air reservoir is attached to the side of the tube instead of enclosing the tube. This allows virtually the entire volume of the tank to be used for air storage and allows the valve parts to be easily accessed for maintenance without dismounting the pressure vessel. The disadvantage of the external valve design is that the air leaving the tank must travel through one or more tight turns before reaching the discharge port. Irregularities in the discharge pathway seriously reduce the force of the air cannon's output blast. This disadvantage becomes proportionally greater as the size of the pressure vessel is increased.

As an example of known prior art designs, U.S. Pat. No. 4,469,247 issued Sep. 4, 1984 discloses a blast aerator for dislodging bulk materials in storage hoppers or the like. The blast aerator tank has an elongated, rigid blast discharge pipe coaxially disposed therewith. A valve seat assembly is coaxially secured against an internal shoulder of the pipe. A resilient dual diameter piston is disposed within an intermediate portion of the pipe for axial movement between a sealing, aerator fill position, wherein its reduced diameter portion abuts the valve seat assembly and a rearward, aerator discharge position. The piston is urged rearwardly when the unit is vented to discharge an air blast U.S. Pat. No. 4,496,076 issued Jan. 29, 1985 discloses a multiple blast aerator hopper system for handling bulk material. This comprises plurality of blast aerators fitted at radially, spaced-apart intervals about the periphery of a hopper needing flow control. The blast aerators are periodically fired in a timed, rotary sequence starting with the first, lowermost aerator and continuing serially with higher, radially spaced-apart aerators. Preferably each aerator includes an internal valve seat assembly which houses a resilient, dual diameter piston for axial movement between the sealing position and a rearward, aerator fill position. An external solenoid valve controls each aerator.

U.S. Pat. No. 6,702,248 issued Mar. 9, 2004 discloses a quick acting blast aerator comprising a spring-less actuator triggered by an exhaust valve. The actuator valve comprises a tubular body, an exhaust vent defined in the body, a dampening passageway, and a piston slidably disposed therewithin for movement between a tank filling position and a displaced, air discharge position. Preferably the piston has a projecting dampener which engages the dampening passageway.

Relatively recently blast aerator designs place the valve at the air supply end of the tube connecting the air supply port to the discharge port. Since the valve is at the opposite end of the pressure vessel from the discharge port where the blast aerator is mounted to the application, it can be more readily accessed for valve maintenance without dismounting the entire air cannon. With the valve located at the air supply end of the tube, the diameter of the entire tube must remain large (i.e., the same size as the discharge port) for the entire length of the pressure vessel. This wastes a considerable amount of the tank's internal volume.

Another shortcoming of the supply end mounted valve involves manufacturing concerns. Typically, a relatively long, four inch diameter tube is mounted in the discharge end of the tank. To ensure internal connections of this tube to the valve requires tight tolerances to align the supply end of the tube accurately in the center of the tank. If this end of the tube is off-center or tilted, the connections are likely to leak. Also, schedule 40 pipe is frequently used for this tube. Its tolerances do not meet the requirements of standard O-ring seals. If this connection leaks, the blast aerator will constantly leak air while in the charged state waiting to be fired.

The basic blast aerator design using a tube connecting the air supply port to the discharge port has worked relatively well for over thirty years. There are a few short comings, however. After the firing of an air cannon, the area on the discharge side of the valve disc, extending down into the discharge pipe, has very low pressure. This allows air from the application, which might contain abrasive contaminants and/or caustic and corrosive chemicals, to be sucked up into the valve, shortening the aerator's useful life, and creating the need for frequent maintenance and replacement of valve components.

Another weakness of the prior art "tube" design is based on theoretical considerations. The majority of air cannons used today in industry have a four inch internal diameter discharge port. Regardless of whether the valve is located at the air inlet port or at the discharge port, there must be openings in the tube ("windows") that allow air accumulated within the aerator tank to rapidly escape via the tube through and out the discharge port. The four inch discharge port has a cross-sectional area of 12.56 sq. in. for air to enter. Traditionally, air cannons use a valve that is the same size as the discharge port. With a valve that is four inches in diameter, the windows in the tube normally have a cross-sectional area smaller than the discharge port by 20% or more. This provides a choke point for the air trying to exit the tank, reducing the force of the blast.

One manufacturer now uses a larger valve placed near the air supply port. This requires the tube at the air inlet end to be a larger diameter, but it allows the windows to be large enough to be greater in cross-sectional area than the discharge port. Tests will be done to see how much more force is obtained by this approach to removing this choke point.

One final disadvantage of the "tube" design is that the disc that opens the path for the air to reach the discharge is subject to the changing pressure and turbulence in the pressure vessel. The disc is controlled by the balance of pressure on the supply side and the discharge side of the disc. As the air leaves the tank a low pressure area develops on the discharge side of the disc causing it to start to close until it is hit again by air trying to leave, which pushes it fully open again. Testing has revealed that this fluctuating pressure on the discharge side of the disc causes the disc to "flutter" back and forth as the air leaves the tank. This constant back and forth movement of the disc can greatly enhance wear. If a spring is used to control the disc and close it quickly after the blast, that spring is compressed and released hundreds of times with each blast. This can severely shorten spring life. Also, if any abrasive contaminants from the application get into the valve (as mentioned above), this back and forth motion can severely abrade the disc and the valve housing. This can significantly shorten valve life.

SUMMARY OF THE INVENTION

This invention provides an improved blast aerator, and a module for the aerator wherein a pneumatic piston and plunger arrangement is used to build up tank pressure and to selectively trigger a discharge. Conventional primary tubing or piping, typical discharge "windows," and conventional actuation valving are eliminated from the interior of the aerator tank. The preferred piston is spring-less. Critical operational air pathways pneumatically control piston movements, air charging and blast discharges.

The preferred blast aerator or air cannon comprises a steel, air accumulation tank with an actuator end that receives a new, retrofittable aerator control module. A tank discharge end mounts a discharge pipe that connects to an internal output tube semi-permanently mounted within the tank by welding or the like. The discharge pipe directs air blasts into an external application, such as a bulk material container. The aerator control module substantially fits within the tank through the serviceable actuator end. The module comprises an external actuator that controls a reciprocating plunger assembly that interacts with an internal plunger seat adaptor to block or unblock blast air flow. The plunger seat adaptor assembly is adapted to be fitted to the aerator output pipe. It comprises a resilient plunger seat that is blocked or unblocked by a plunger element controlled by a slidable actuator piston that is pneumatically displaceable between tank-filling and tank discharge positions within the actuator. The plunger assembly mechanically compensates for output tube misalignment to insure proper sealing.

Thus a basic object of this invention is to provide a blast aerator whose critical innards can be changed without removing the aerator tank itself from its application.

A basic goal is to provide user-access to all blast aerator parts without requiring the cumbersome dismounting and then remounting of the aerator tank from the application.

A related object is to locate the aerator's critical actuator outside the pressure vessel, protected from any contaminants that might be pulled up into the tank after firing within the discharge pipe.

A related object is to secure the aerator actuator outside the air cannon pressure vessel, isolating it from changing pressures, turbulence and the like to eliminate actuator piston flutter and the excessive wear this flutter causes.

It is also an object to provide a blast aerator and a repair module for an aerator wherein parts are accessible from a single end of the unit. It is a feature of the invention that the actuator, plunger assembly, and plunger seat adaptor assembly can all be installed or serviced from the mount flange on the end of the tank opposite the discharge pipe and mount.

It is also an important object to eliminate the discharge tube windows that characterize prior art blast aerator designs.

Another object is to provide an aerator and repair actuator module where the piston operates without a conventional mechanical spring. It is a feature of my invention that the piston is controlled pneumatically with suitable ports and air passageways for complete control.

Similarly it is an object to provide a "tubeless" design wherein the actuator is external to the tank and thus is not influenced by the air movement in the tank. This greatly reduces flutter of the actuator piston and wear on the piston and actuator housing.

Of course it is a basic object of this invention to provide a blast aerator of significantly improved efficiency and operating life.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
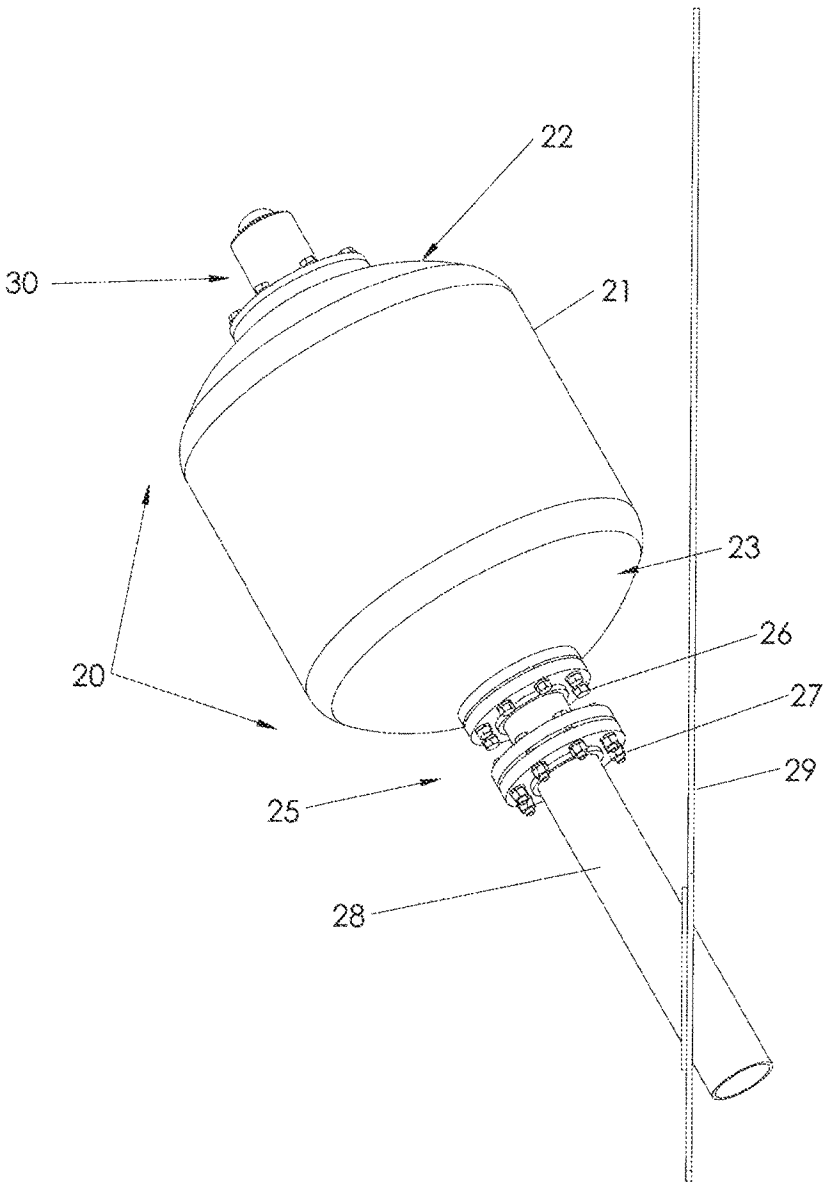
FIG. 1 is a fragmentary, isometric view of a Plunger-Activated Blast Aerator constructed in accordance with the best mode of the invention, shown mounted to a typical application.
Figure 2:
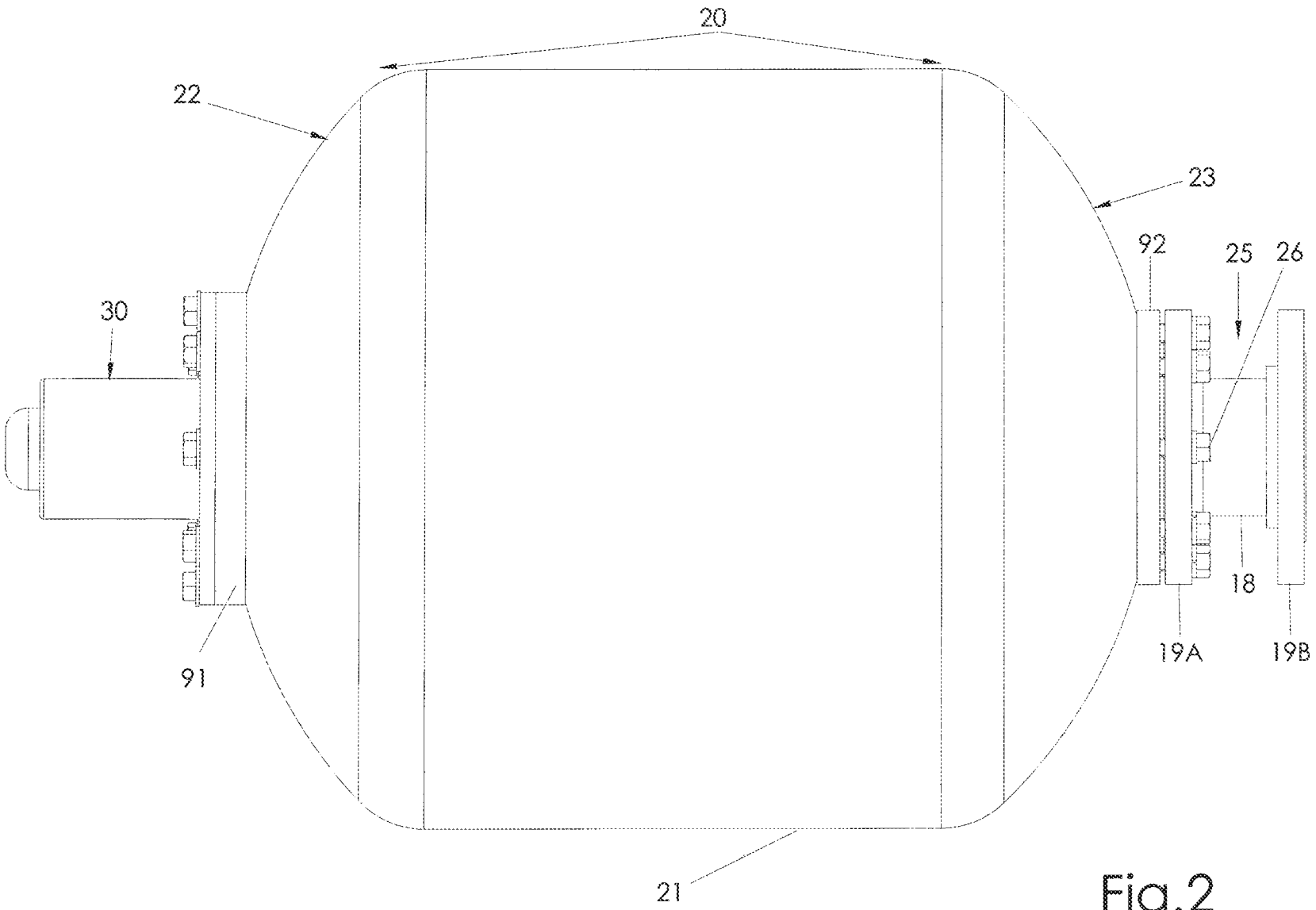
FIG. 2 is an enlarged, side elevational view of the aerator, with the discharge pipe disconnected.
Figure 3:
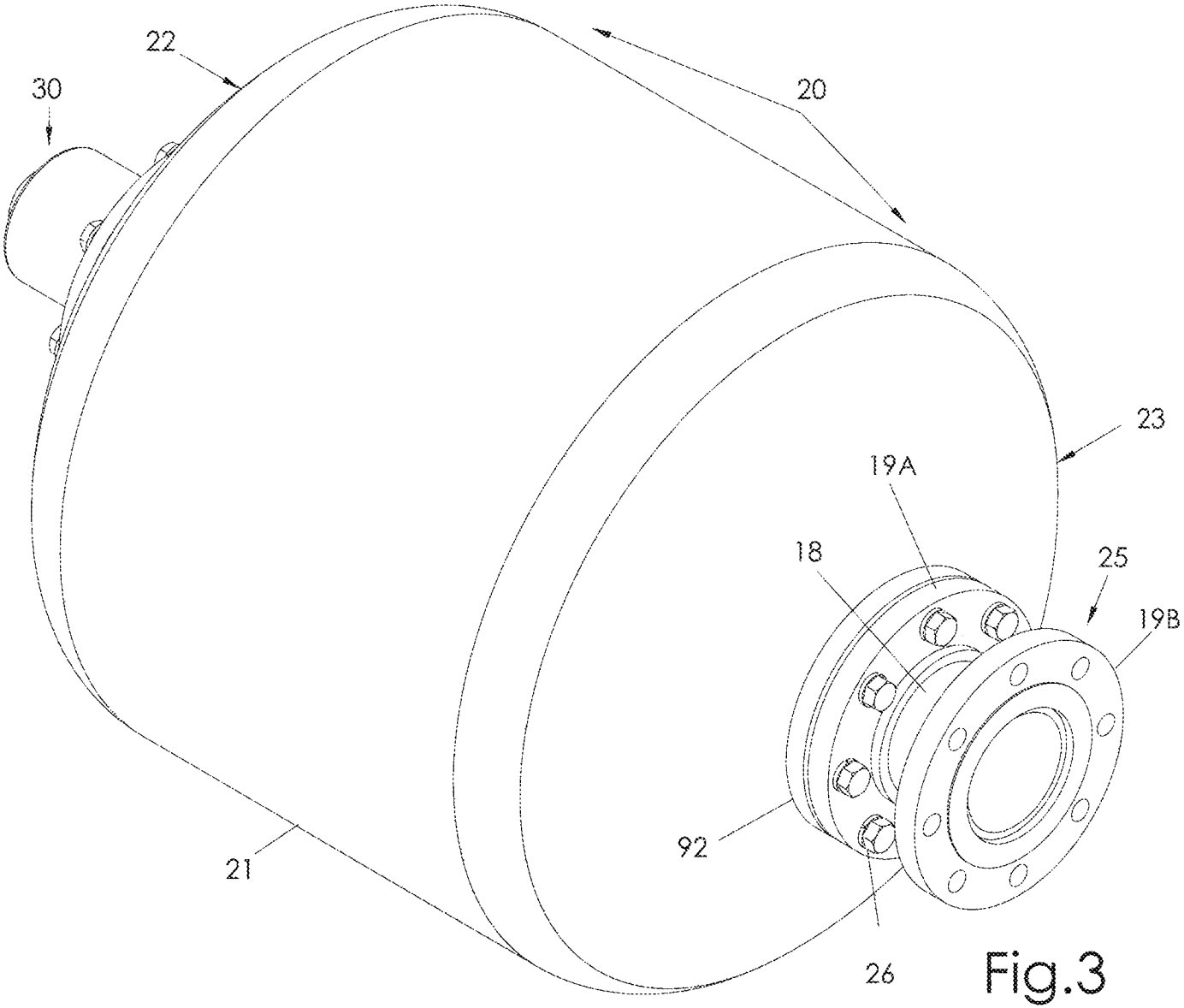
FIG. 3 is an enlarged, rear isometric view of the aerator, with the discharge pipe disconnected.
Figure 4:
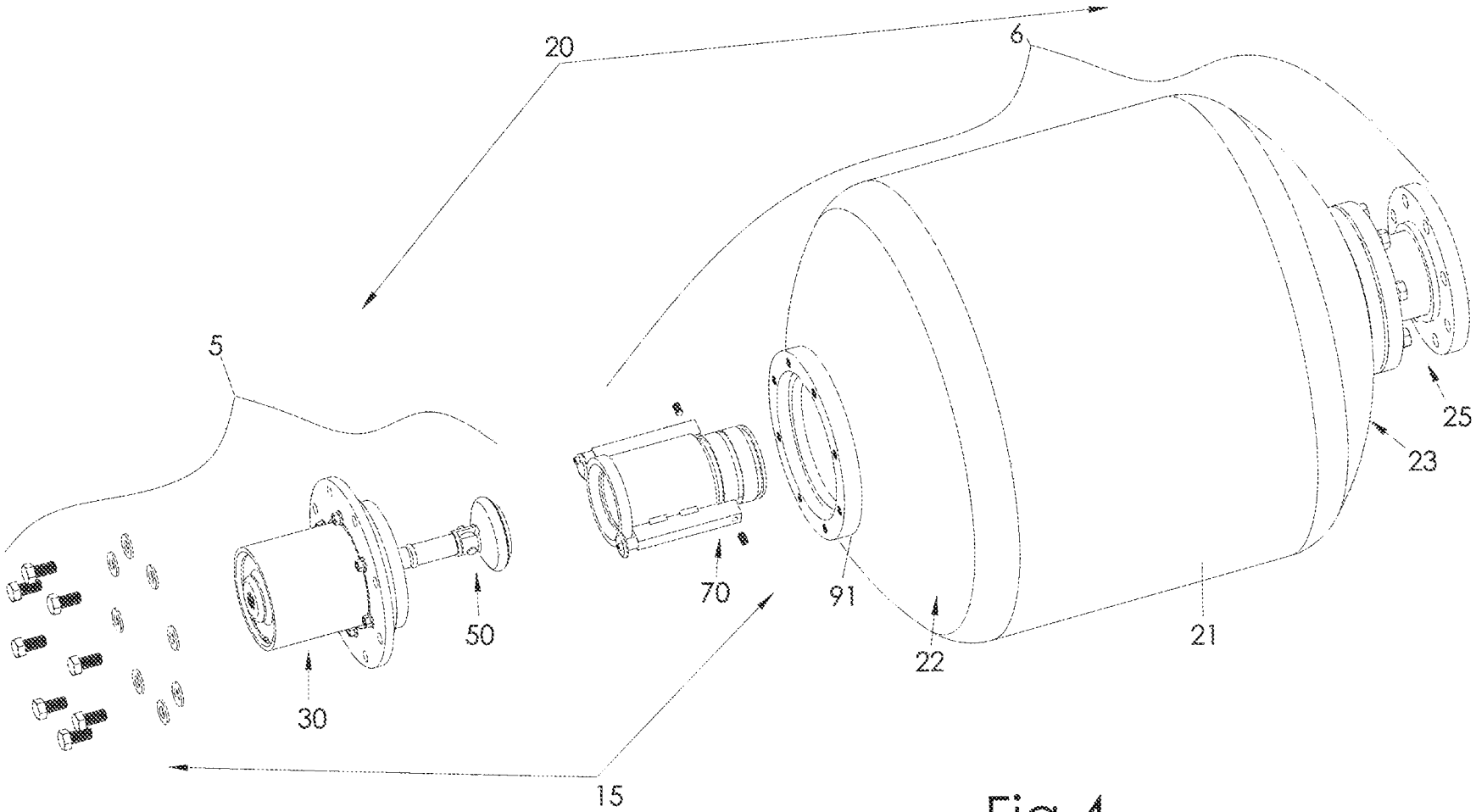
FIG. 4 is a fragmentary, partially exploded, isometric assembly view thereof, with the discharge pipe disconnected.
Figure 5:
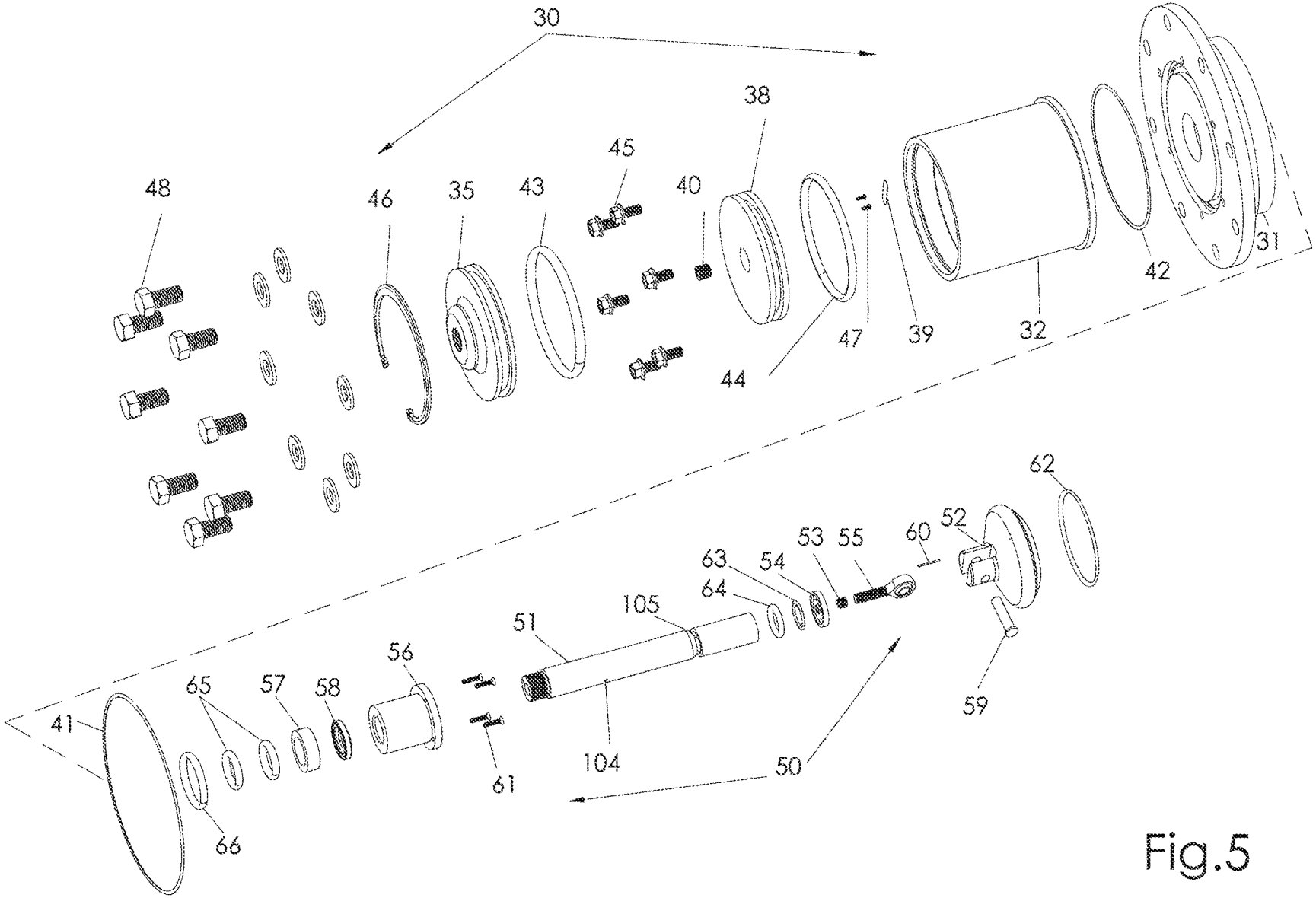
FIG. 5 is an enlarged, fragmentary isometric view derived from region "5" in FIG. 4.
Figure 6:
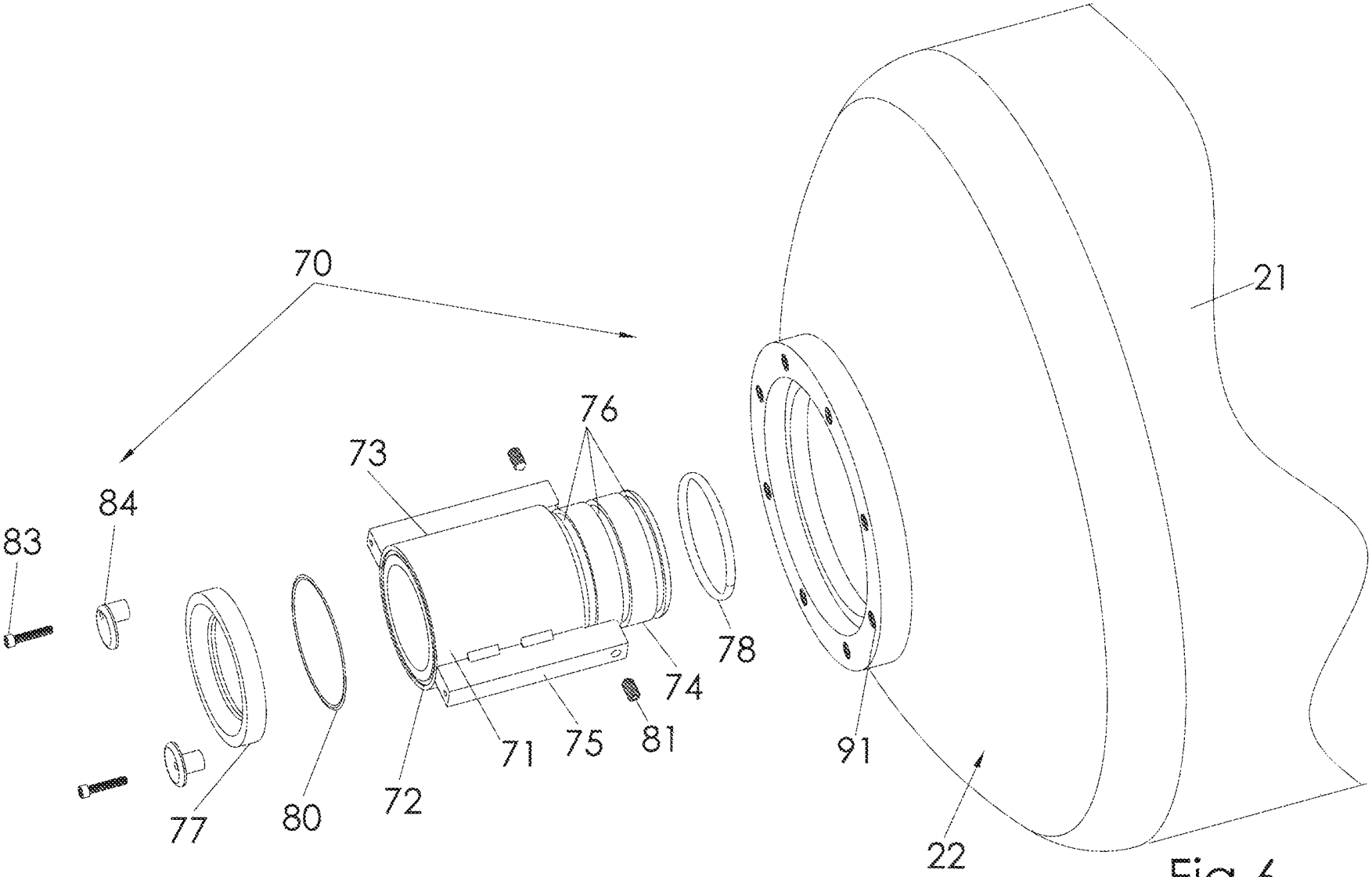
FIG. 6 is an enlarged, fragmentary isometric view derived from region "6" in FIG. 4.

Turning initially to FIGS. 1-6 of the appended drawings, a blast aerator or air cannon constructed in accordance with the best mode of the present invention has been generally designated by the reference numeral 20. The new retrofittable aerator module 15 seen in FIG. 4 and elsewhere, is employed by aerator 20 and it is adapted to be fitted to older, preexisting blast aerators for replacing their innards without removing the aerators from their mountings or application.

Blast aerator 20 comprises a rigid, preferably steel, high-pressure air accumulation tank 21 having a pair of spaced-apart, tapered ends 22, 23. The actuator end 22 of the blast aerator supports an actuator 30 to be described below. In an actual installation, the actuator end 22 is most conveniently accessible by service personnel. The tank discharge end 23, on the other hand, is mechanically braced and connected to an application, such as a storage bin or tank, and is not easily serviced or accessed.

Aerator discharge end 23 terminates in a conventional coupling 25 which may comprise two annular, spaced apart flanges 19A, 19B connected by a piece of four inch ID pipe 18. Flange 19A is mechanically attached to another flange 92 on the aerator 20 with a plurality of threaded fasteners 26. The coupling 25 attaches the blast aerator 20 to a discharge pipe 28 with fasteners 27 (i.e., FIG. 1), and directs air blasts into an application, such as a bulk material tank, hopper or granular material reservoir through a wall 29 of the application. Discharge pipe 28 passes through and may mechanically connect to the wall 29, so that the aerator 20 can periodically, forcibly discharge air blasts interiorly of the application, to loosen bulk materials therewithin and promote material flow, as will be recognized by those skilled in the art.

Importantly, an externally mounted actuator 30 initiates air blasts from the aerator. With joint reference now directed to FIGS. 4-11, the actuator 30 controls a plunger assembly, designated generally by the reference numeral 50 (i.e., FIG. 7), that is adapted to be positioned within the tank 21. Actuator 30, mounted on actuator tank end 22, interacts with a plunger seat adaptor assembly 70 to interiorly block or unblock blast discharge air flow. As appreciated from FIG. 8, for example, in operation the plunger assembly 50 selectively blocks or unblocks air flow through seat adaptor assembly 70, a high pressure air outlet pathway 204 (FIG. 8) established by an internally mounted, semi-permanent aerator output tube 24, coupling 25, pipe 18 and discharge pipe 28 (FIG. 1). Output tube 24 is conventionally associated within the tank of most blast aerators, and may be welded to flange 92 at the discharge end 23 of the aerator tank 21. When unblocked, high pressure air rushes out through the air outlet pathway 204 through the discharge pipe 28 into the intended application. The tank interior 203 is periodically charged with HP air provided by a normal industrial HP air interconnection coupled to actuator 30 exteriorly of the tank. Air flow and aerator pressurization charging are discussed below.

The rigid, tubular output tube 24 is centered within the tank 21 by a bushing flange 92 welded into the tapered discharge end 23 of tank 21. It is joined via coupling 25 to the discharge pipe 28 discussed above (FIG. 1). Fasteners 26 secure coupling 25 to conventional bushing flange 92, and fasteners 27 (FIG. 1) secure the coupling 25 to the discharge pipe 28 (FIG. 1). The air outlet pathway 204 within output tube can be unblocked to periodically conduct air from tank interior 203 to the outside of the tank.

In assembly, the generally tubular plunger seat adaptor assembly 70 is coaxially fitted to the output tube 24. It has a seat 77 (FIGS. 11, 12) described below that engages a plunger for air control. Referring primarily to FIG. 13, the adaptor assembly 70 comprises a plunger adaptor 71 that coaxially engages output tube 24. Adaptor 71 comprises a rigid, tubular body 73 that is coaxial and integral with a reduced diameter, terminal base portion 74 (FIG. 8) that fits within preexisting output tube 24. The coaxial base portion 74 comprises a plurality of ring grooves 76, at least one of which is used to seat a conventional O-ring 78 for providing a seal between adaptor 71 and output tube 24. The end of the plunger adaptor 71 opposite reduced diameter portion 74 is the seat mount surface 72. The plunger seat adaptor assembly 70 also includes two externally mounted weldments 75 (i.e., FIG. 13) that run down opposite sides of the plunger adaptor tubular body 73. These mount weldments 75 secure the plunger adaptor 71 to the output tube 24 when clamped in place with two set screws 81. A generally circular or annular plunger seat 77 coaxially seals against the plunger adaptor seat mount surface 72 with a conventional O-ring 80 and is secured by two circular retainers 84, which coaxially surround the periphery of the seat 77. The retainers 84 are secured to the weldments 75 with fasteners 83. The retainers 84 are adequately spaced so that the adjustable seat 77 can be positioned for proper alignment when contacted by the plunger assembly as described below.

Figure 7:
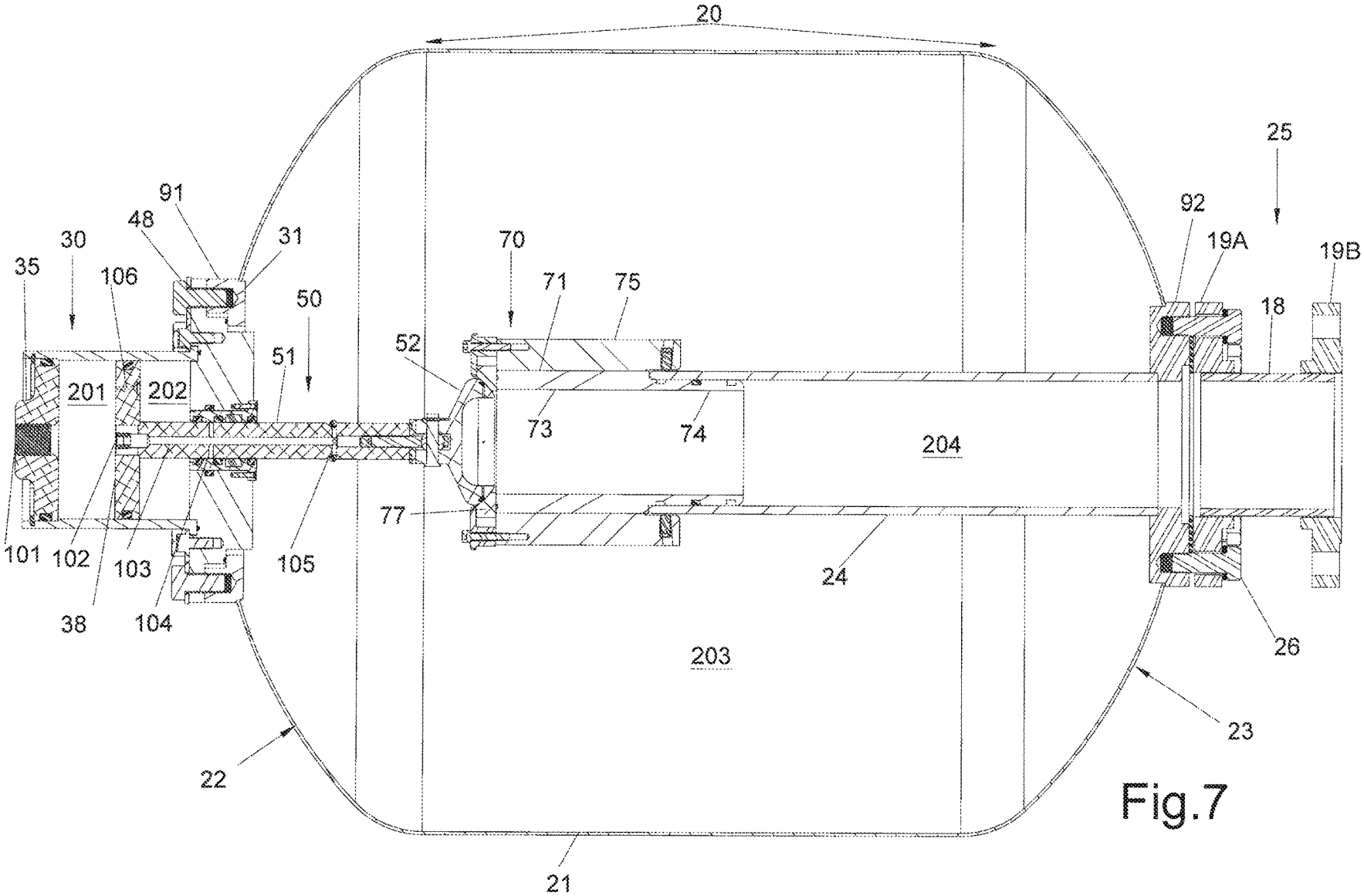
FIG. 7 is an enlarged, longitudinal sectional view of the new blast aerator.
Figure 10:
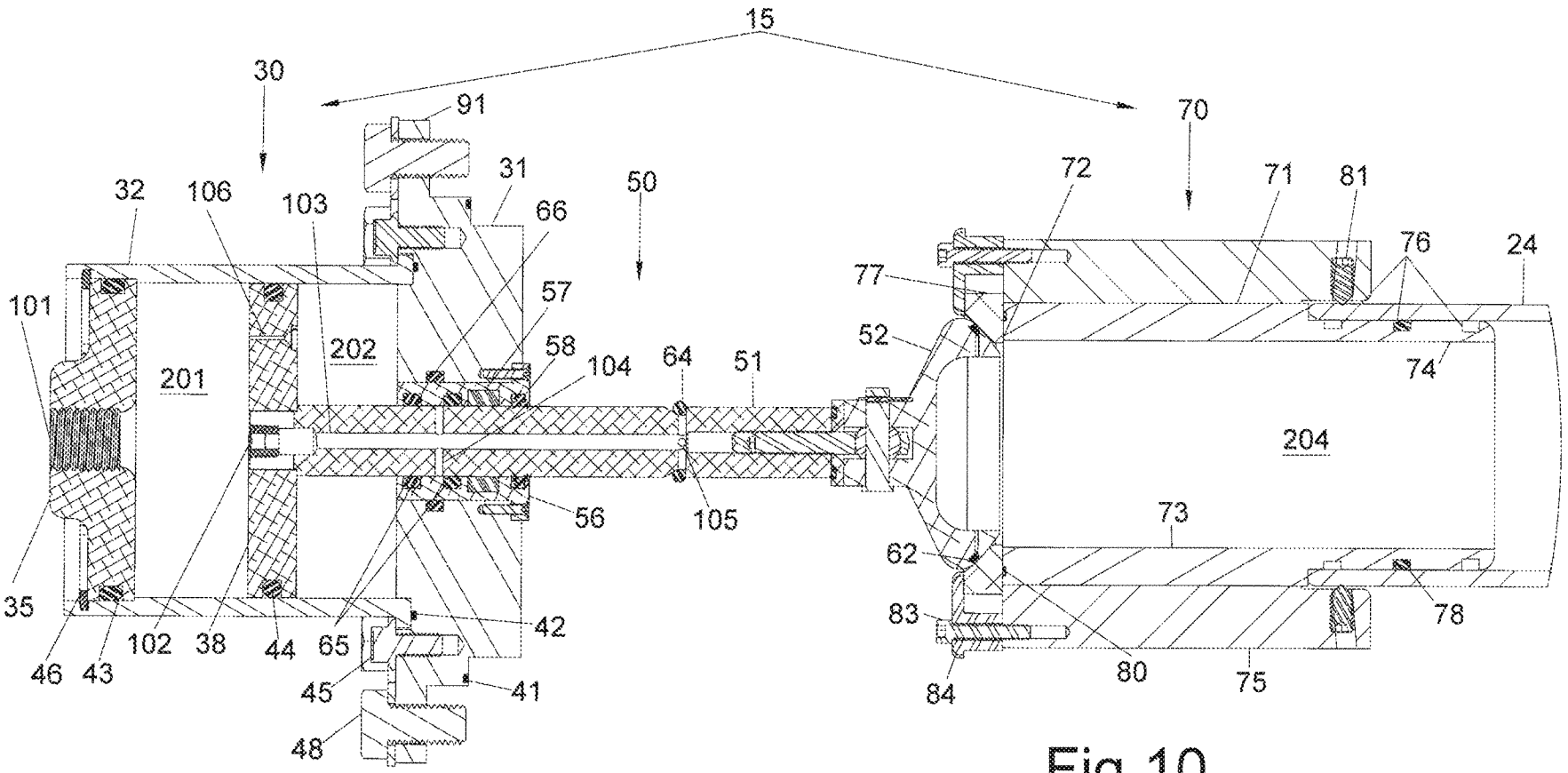
FIGS. 10, 11, and 12 are enlarged, fragmentary, sectional views similar to FIGS. 7-9 showing the plunger and its controller apart from the vessel tank.
Figure 11:
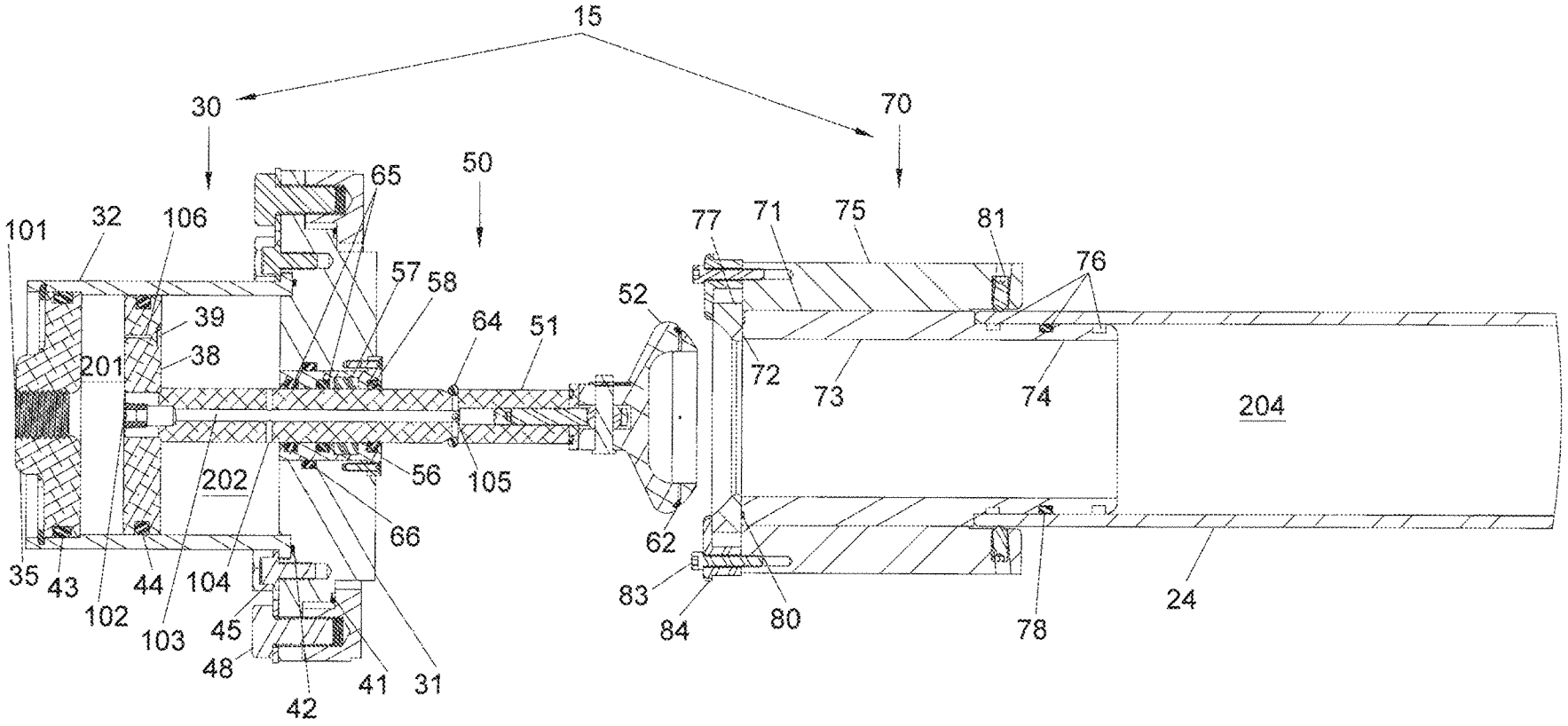
Figure 12:
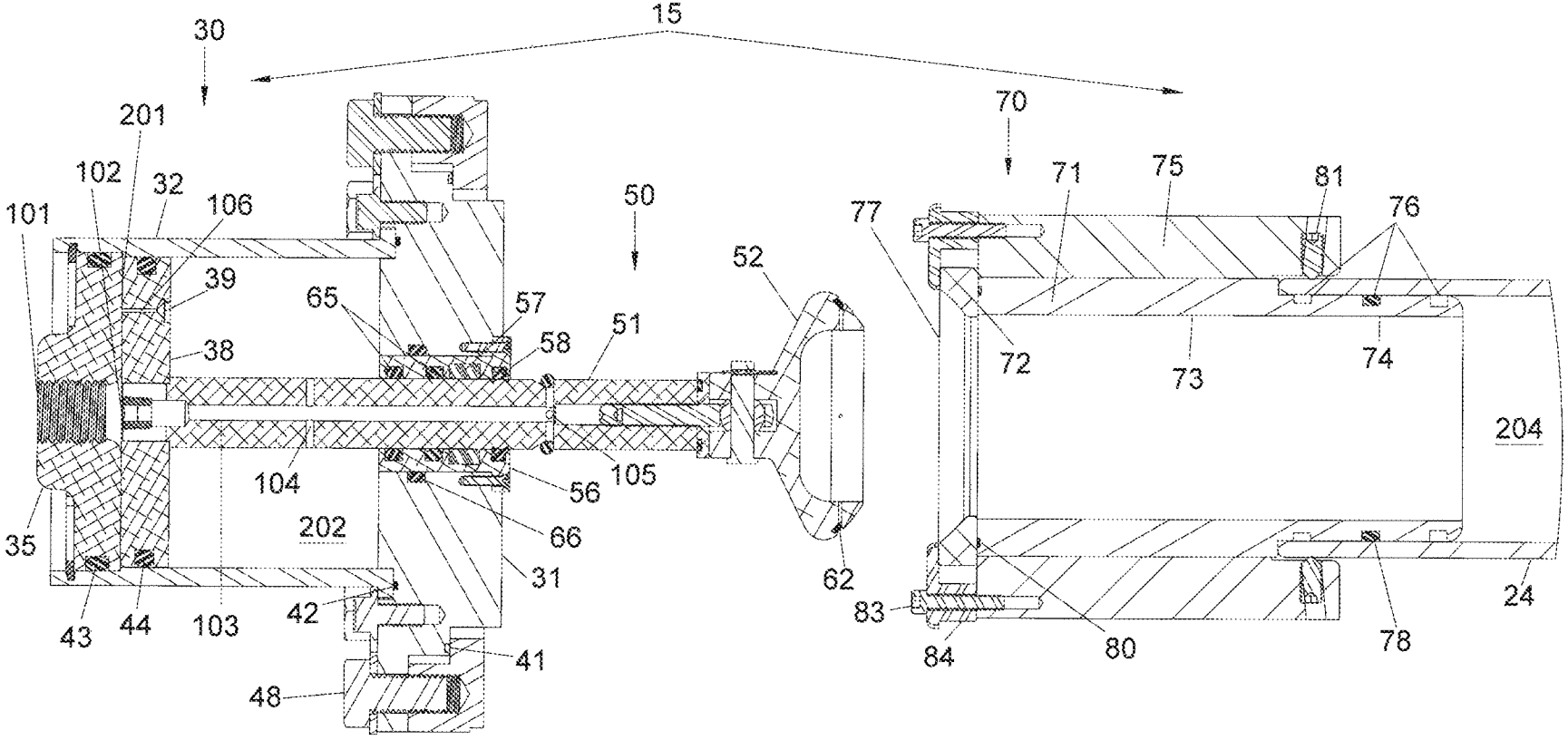
Figure 13:
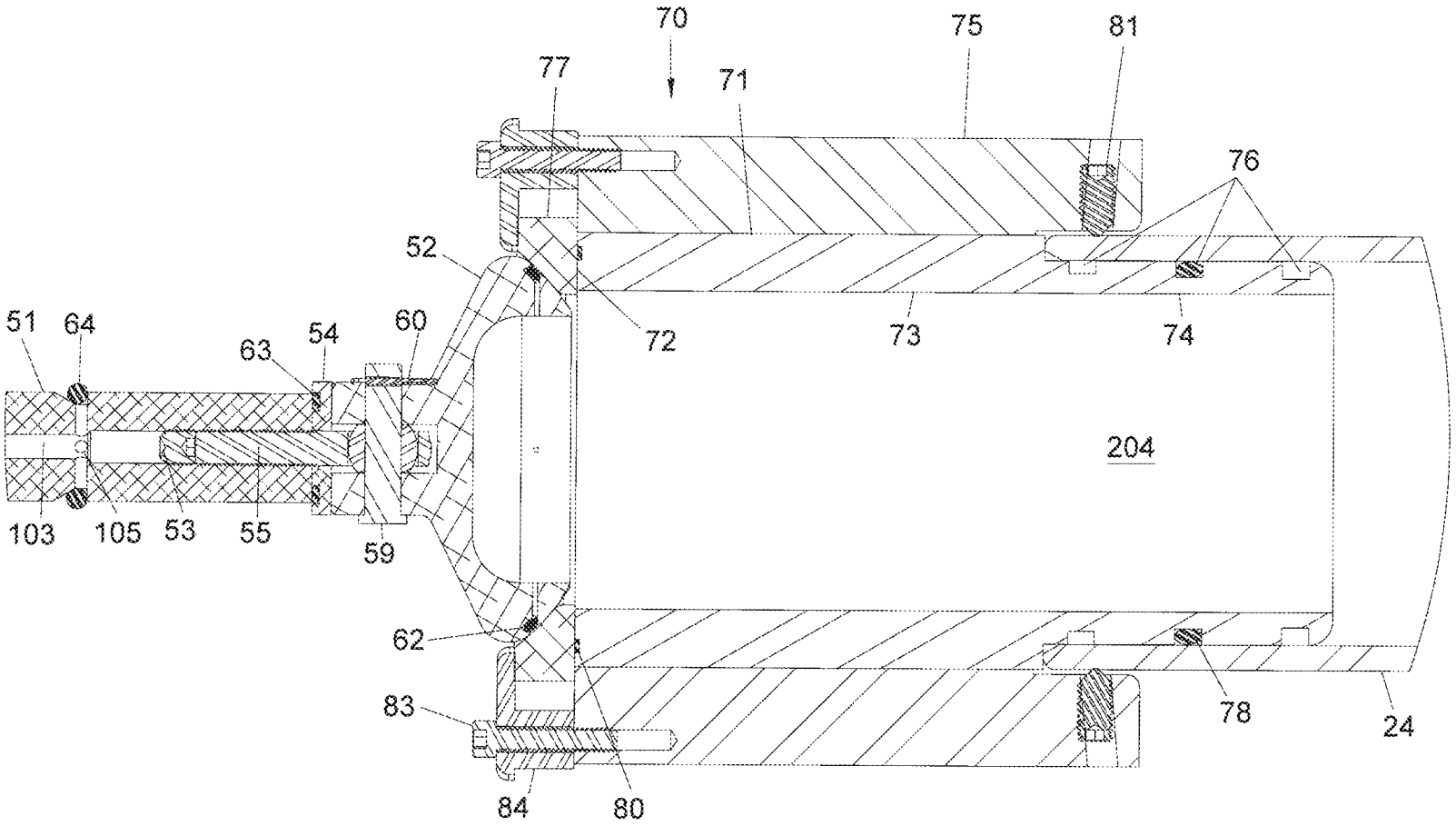
FIG. 13 is an enlarged, fragmentary sectional view of the plunger engaged with the adaptor assembly.
Figure 14:
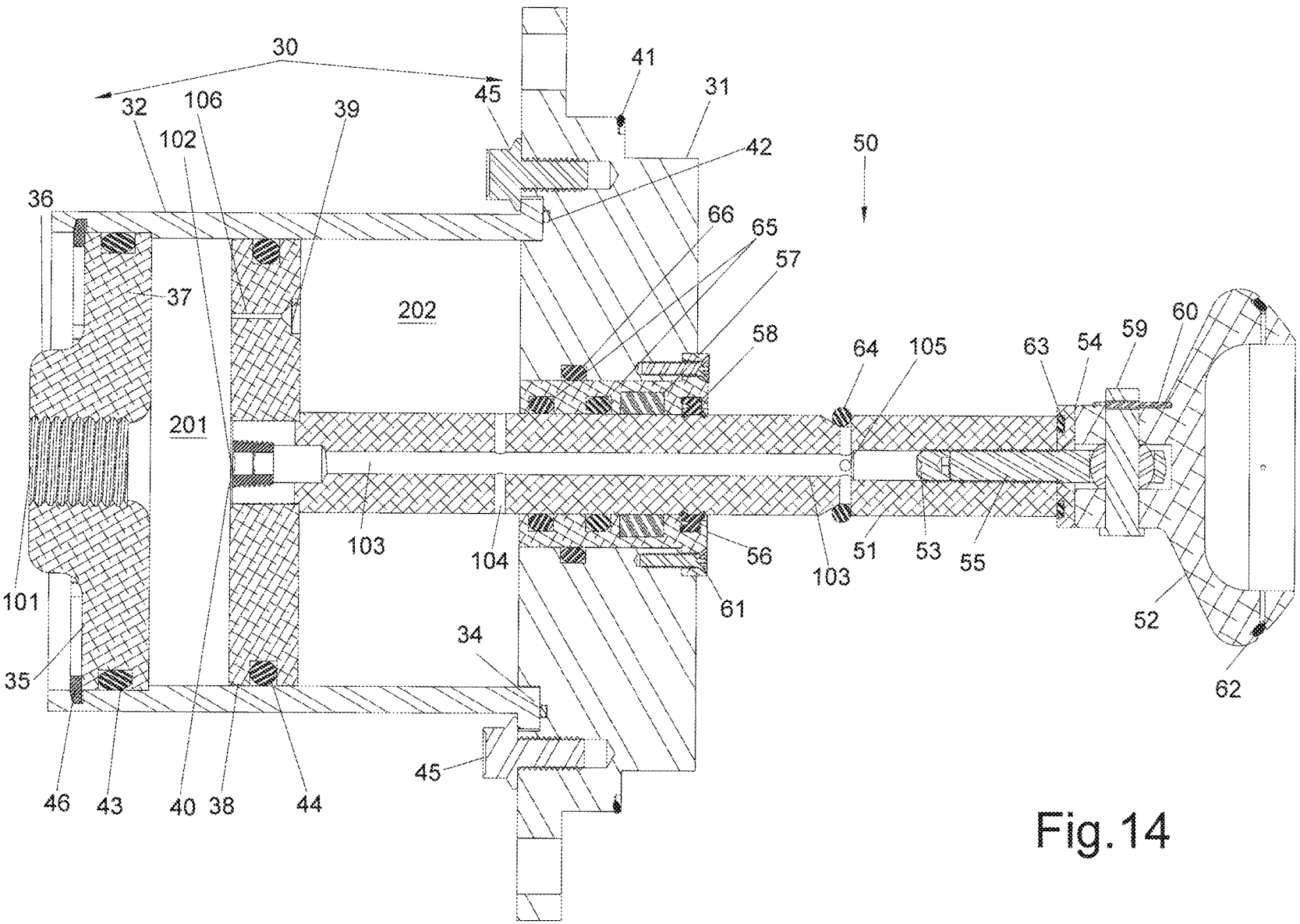
FIG. 14 is an enlarged, fragmentary sectional view of the externally mounted plunger controller.

The actuator 30 interacts with the plunger seat adaptor assembly 70 discussed above for aerator operation, as suggested, for example, by FIGS. 11 and 12. Actuator 30 is externally and coaxially secured to the actuator end 22 of the tank 21 by a rigid, circular mounting flange 31 (i.e., FIGS. 5, 7, 10) that is coaxially secured to the tank inlet flange 91 by suitable fasteners 48 (FIG. 7, 11). A rigid, tubular actuator housing 32 (i.e., FIGS. 5, 10, 11) is coaxially retained upon the mounting flange 31 by flanged bolts 45 that abut against actuator housing rim 34 (FIG. 14), which is coaxially seated within an annular ring groove defined within mounting flange 31 (FIG. 14). O-ring 42 (i.e., FIG. 14) seals rim 34.

An actuator cap 35 comprises a generally convex dome 36 (i.e., FIGS. 10, 14) and an integral, coaxial base 37 that is sealed within actuator housing 32 by a suitable O-ring 43, being secured by a retaining ring 46 (FIG. 10, 14) seated within a suitable ring groove. There is an elongated, threaded air inlet passageway 101 coaxially penetrating the actuator cap dome 36 that provides an input for factory HP air. Passageway 101 leads to an interior cavity 201 (FIG. 10, 14) defined between a slidable actuator piston 38 and the cap base 37. The spring-less piston 38 deflects and controls a plunger assembly 50 (i.e., FIGS. 14, 16) to block (i.e. FIGS. 10, 13) and unblock passageway 204 (i.e., FIGS. 8, 9, 11, 12) discussed above.

Referencing FIGS. 11-16, the plunger assembly 50 periodically blocks the air outlet pathway 204 previously discussed. Plunger assembly 50 comprises an elongated, rigid plunger rod 51 (FIG. 16) that interiorly, coaxially penetrates actuator 30 and mechanically anchors to the slidable actuator piston 38 (i.e., FIGS. 11, 14). The actuator piston 38 is prevented from loosening from the plunger rod 51 by a NPT expansion fitting 40 which screws into the split, internally threaded end of the plunger rod 51. As the NPT expansion fitting 40 is tightened the OD of the plunger rod is pushed outward preventing the actuator piston 38 from coming loose from the plunger rod 51. The NPT expansion fitting 40 has a coaxial hole through the center serving as the plunger rod entry port 102 allowing air in space 201 to pass through the NPT expansion fitting 40 to plunger rod airway 103. Actuator piston 38 controls plunger rod movement. Rod 51 coaxially passes through a resilient wear insert 56 (FIG. 14) mounted in the actuator mount flange 31 which is secured by mounting screws 61 (FIG. 14). The wear insert 56 is sealed by a concentric O-ring 66 seated with a ring groove within mounting flange 31. The rod 51 passes through the wear insert 56 and is sealed by concentric O-rings 65 and a concentric seal/wiper 58, which prevents contaminants that enter the tank from reaching the actuator. Between the O-rings and seal/wiper is a wick lubricator 57, which lubricates the plunger rod where it passes through the seals, minimizing wear and heat build-up that can occur from the extremely rapid movement of the plunger rod during blast aerator use. The concentric seal/wiper 58 also helps to keep the lubrication provided by the wick lubricator 57 confined to the section of the plunger rod that moves within the wear insert 56.

Figure 15:
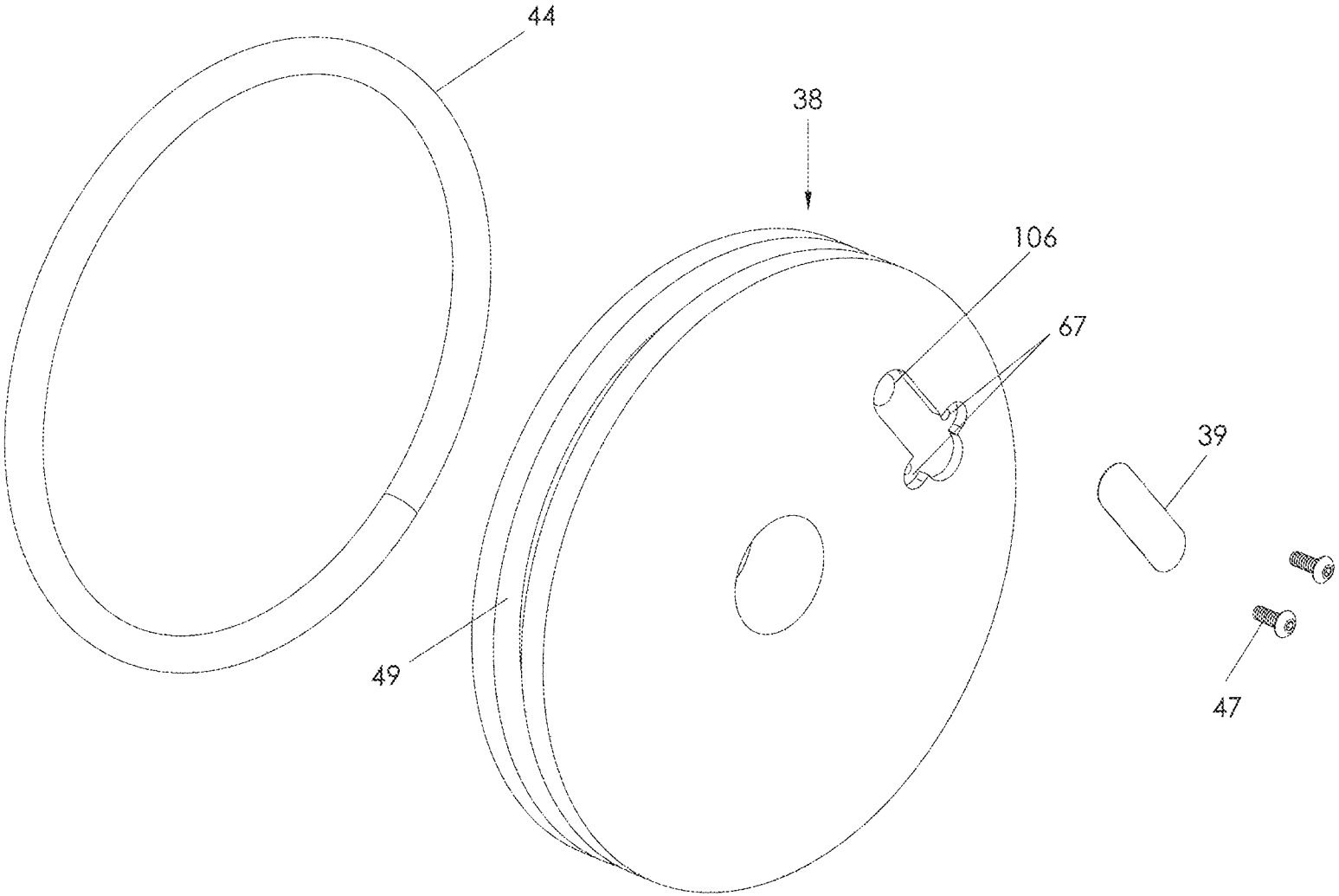
FIG. 15 is enlarged, exploded isometric assembly view of the actuator piston and plunger details, including the preferred one-way reed valve; and, FIG. 16 is enlarged, fragmentary, longitudinal sectional view of the plunger assembly; and, FIG. 17 is enlarged, fragmentary sectional view taken generally along line 17-17 of FIG. 16.

Actuator piston 38 is displaceable coaxially within actuator housing 32, being sealed by an appropriate O-ring 44 seated within peripheral ring groove 49 (FIG. 15). A small vent 106 (i.e., FIGS. 14, 15) passes through the thickness of the actuator piston 38 connecting a first cavity 201 with second cavity 202, the space between the actuator piston 38 and the actuator mount flange 31. This vent 106 is controlled by a one-way reed valve 39 (FIG. 14, 15) held by fasteners 47 (FIG. 15) seated within partial orifices 67. When air pressure is applied through passageway 106 it pushes the reed valve back to let air flow into space 202. When air pressure drops in 106 the reed cannot bend the other way because it fits snugly against the piston, thus air cannot flow back from space 202 into 106. An elongated plunger rod airway 103 extends through plunger rod 51, communicating with plunger rod entry port 102 (FIG. 14), four radially spaced-apart plunger rod exit ports 105, and travel control ports 104 (FIG. 14). A concentric O-ring 64 fits into a concentric groove in the plunger rod 51 at the site of exit ports 105 to form a check valve, which controls the flow of air through the plunger rod exit ports 105. The O-ring 64 can be resiliently deflected away from the encircled ports 105 to open them by internal pressure, but it closes ports 105 in response to external pressure.

Figure 16:
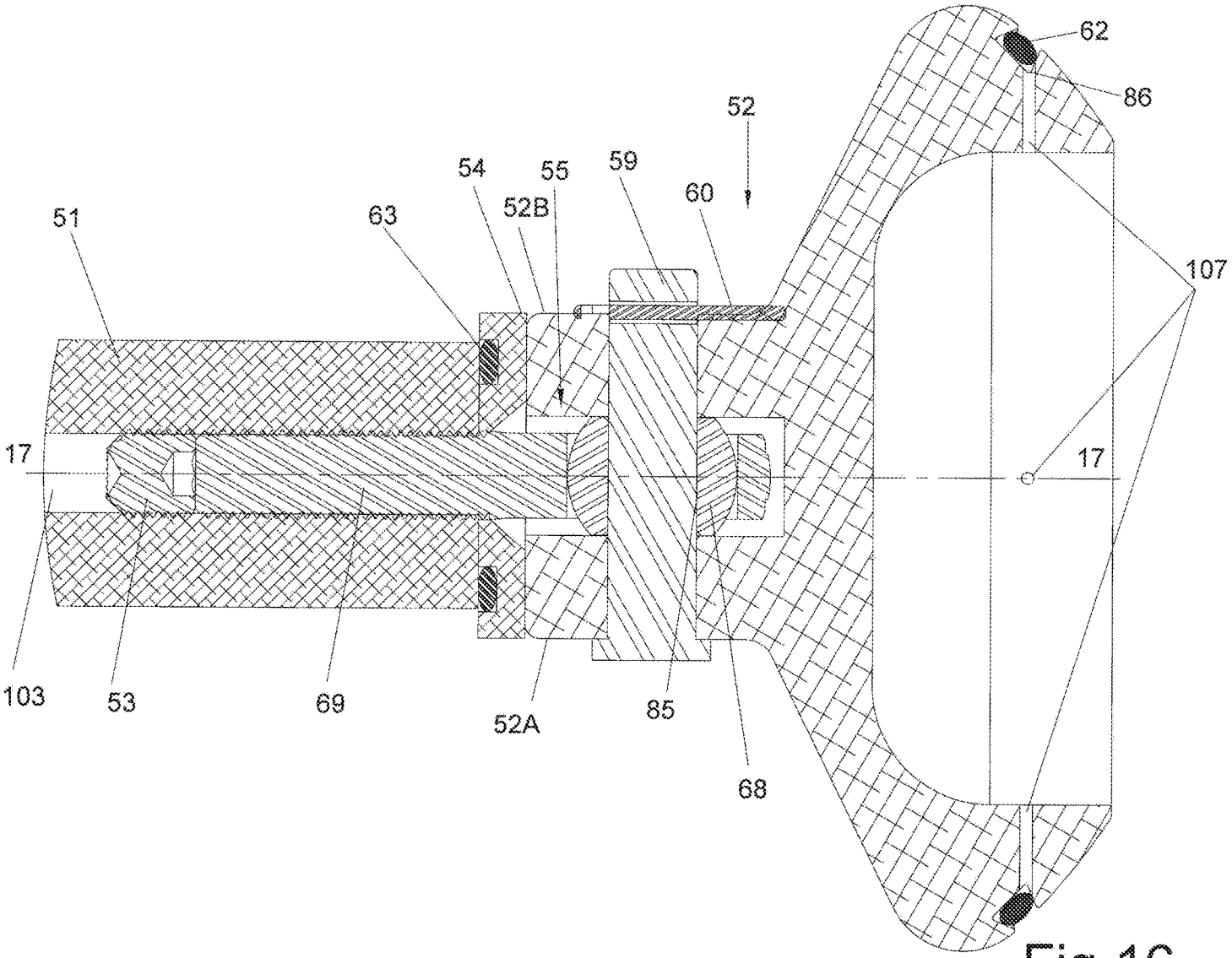
Figure 17:
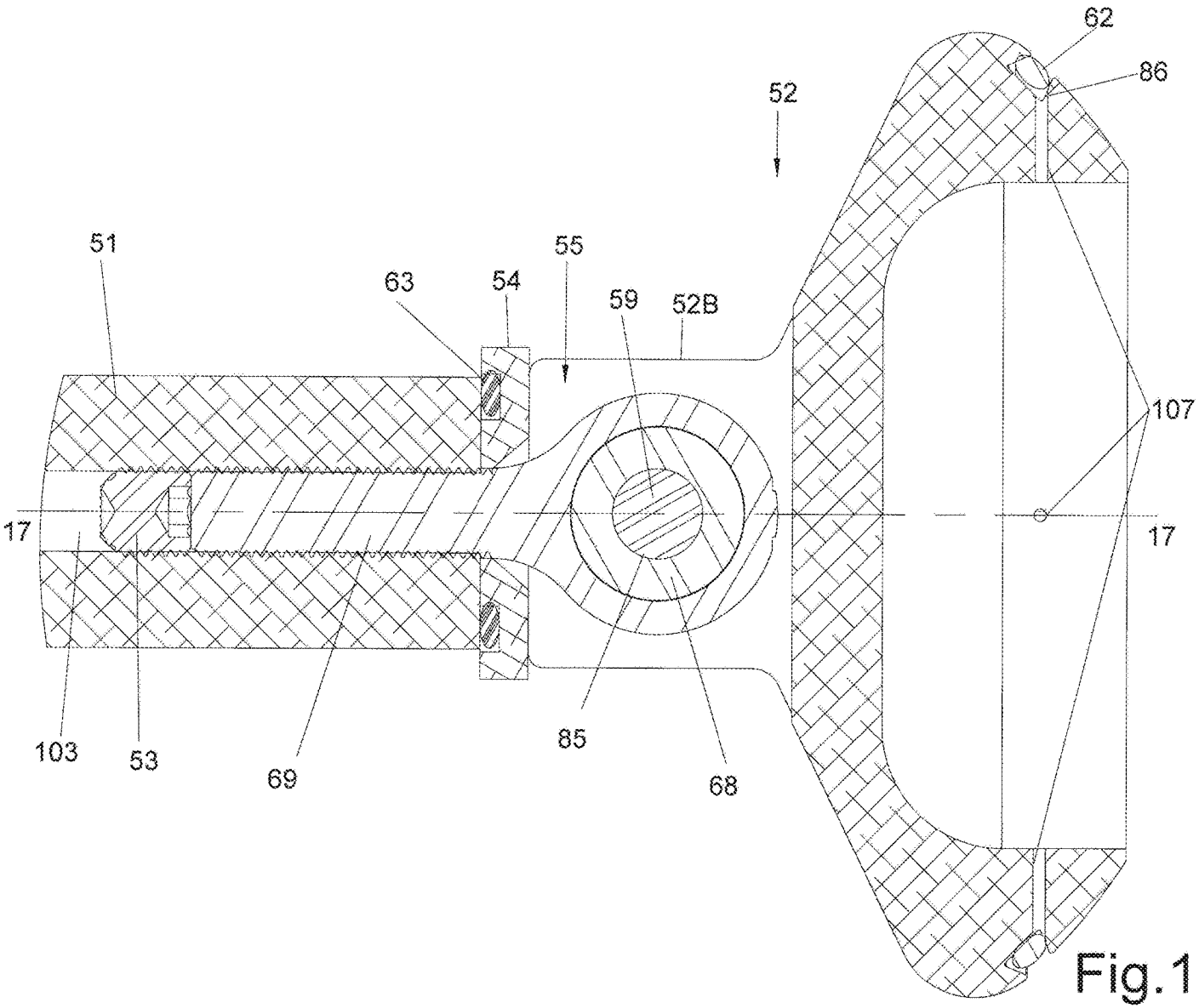

The plunger sealing element 52 (i.e., FIGS. 16 and 17) is periodically forced against or withdrawn from the previously described seat 77 (i.e., FIG. 10, 11, 12) during aerator operation. Alignment is assured by connecting the plunger element to the plunger rod with a male threaded ball joint end rod fitting 55 comprised of a ball joint 68 with eyelet 85 located centrally and a ⅜-24 male threaded rod end 69. A McMaster-Carr ball joint, model #60645K14, suffices. The ball joint end 68 of the fitting 55 connects to the double neck 52A and 52B of the plunger sealing element 52. The ball joint 68 (FIG. 16) fits into the space between the two necks 52A and 52B and is secured by a transverse, capped fastener 59 that passes through a hole in the neck 52A, through the ball joint eyelet 85, and through the hole in the other neck 52B. The transverse, capped fastener 59 is held in place by a cotter pin 60 (FIG. 16). A resilient cushioning ring 54 abutting the remote end of the plunger rod 51 also abuts the double neck 52A and 52B of plunger sealing element 52. An O-ring 63 fitted into an appropriate groove on the cushioning ring 54 sits between the cushioning ring 54 and the remote end of the plunger rod 51. The male threaded end 69 of the ball joint fitting 55 passes through the center of the cushioning ring 54 and is threadably secured in the threaded ID opening of the plunger rod 51. The ball joint fitting 55 is tightened until the plunger sealing element 52 is snug against the cushioning ring 54 such that the cushioning ring O-ring 63 has not been flattened. Using the threaded ball joint end rod fitting 55 in this way (FIG. 17) allows the plunger sealing element 52 to swivel several degrees in all directions, while the cushioning ring 54 with O-ring 63 keeps the plunger element 52 fairly straight and aligned without restricting the range of motion of the ball joint. A preload set screw 53 (FIG. 14) is inserted through the plunger rod entry port 102 and down through the plunger rod airway 103 and into the same threaded hole holding the male threaded ball joint fitting 55. A preload set screw 53 is tightened against the ball joint end rod to prevent it from loosening. An O-ring 62 seated in a vented dovetail groove 86 cut into the nose of the plunger sealing element 52 provides a seal when aligned with the plunger seat 77 to prevent air leakage from the internal tank space 203 into the air outlet pathway 204 when the blast aerator is fully charged and waiting to be fired (FIG. 13). The dove tail groove 86 with six vent airways 107 are used to prevent the O-ring 62 from becoming displaced from the face of the plunger nose when the plunger is abruptly pulled back and away from the plunger seat 77 during firing of the air cannon.

Alignment of the plunger sealing element 52 with the seat 77 can be critical. Normally the discharge tube 24 in older blast aerators being repaired by the retro-fittable aerator control module 15 is traditionally schedule 40 pipe that is welded in place. The end of that tube, and thus the seat, most likely will not be in alignment with the plunger. To have an air tight seal, the plunger needs to rock slightly in all directions while maintaining basic alignment at all times, which the ball joint end rod 55 and the cushioning ring 54 with O-ring 63 provide.

Primarily referencing FIG. 13, the plunger assembly 50 comprises a plunger element 52 which mates with and seats within a plunger seat 77, which is part of the plunger seat adaptor assembly 70 previously described. The plunger assembly construction compensates for misalignment of the output tube 24 which is welded into the tank discharge flange 92. Accurate placement and orientation of the discharge tube has proven difficult for the tank manufacturers. Misalignment would interfere with proper seating of the plunger sealing element 52 in the plunger seat 77, allowing the blast aerator to leak while charged and awaiting next discharge. The plunger seat adaptor can also accommodate standard variations in the ID of schedule 40 pipe commonly used for the discharges in blast aerators.

Plunger seat adaptor base 74 has a plurality of spaced-apart ring grooves, preferably three. The grooves are set at three different depths. The groove closest to the end is the deepest while the groove farthest from the end is the most shallow. Only one O-ring is used. Depending on the actual ID of the discharge pipe, one of the grooves will give the best fit.

The adaptor base O-ring 78 (FIG. 13) is placed in the first O-ring groove closest to the end of the adaptor base 74. The plunger adaptor 71 is inserted in the output tube 24. If it fits snugly it is left in place and the installation continues. If it is loose, the plunger seat adaptor is removed, the O-ring is moved to the center groove, and the adaptor is re-inserted in the output tube 24. If it fits snugly it is left in place. If the adaptor is still loose the O-ring is moved to the most shallow groove. This placement of the O-ring should give a snug fit as the varying depths of the 3 grooves should cover the full range of possible ID's on standard schedule 40 pipe.

The adaptor mount set screws 81 are threaded into the two plunger seat adaptor mount weldments 75 and when tightened against the output tube 24 at the position of the base end of the mounted plunger seat adaptor base, they secure the plunger seat adaptor assembly 70 to the output tube 24. The plunger seat 77 is placed on the plunger seat adaptor mount surface 72 with the plunger seat O-ring 80 properly seated between the seat and the mount surface 72. The seat is secured using the retainers 84 which are attached to the plunger seat adaptor mount weldments 75 with the retainer fasteners 83. The seat is positioned centered over the opening in the plunger seat adapter and the fasteners are tightened loosely. The plunger/actuator assembly is inserted into the tank inlet flange 91 and the plunger is used to center the seat to be in proper alignment with the plunger. The plunger/actuator assembly is removed and the retainer fasteners are tightened to hold the seat firmly in the properly aligned position, which in likelihood will not be concentric with the opening in the plunger seat adaptor.

This puts the seat in the proper axial alignment for the plunger however the seat can still be tilted out of position. To compensate for this misalignment the plunger and the plunger seat mating surfaces are cut spherically. Also, the plunger is mounted on a ball joint to allow the plunger to swivel a few degrees to compensate for small angular errors in the seat position. This prevents leaking of the blast aerator when it fully charged and waiting to be fired. This is necessary so that the plunger will properly align with seat to seal off output tube 24 so the air cannon tank 21 can be charged with compressed air.

Operation:

A.) Compressed air enters the top of the actuator 30 through the air inlet port 101 (FIG. 14) located in the top of actuator cap 35 and passes into the actuator cylindrical interior (i.e., cavity 201 between the actuator piston 38 and the base 37 of the actuator cap 35).

B.) From cavity 201 compressed air passes through the piston 38 and into the plunger rod, entering through entry port 102 and passing through plunger rod airway 103, and opening the check valve provided by O-ring 64 that can be deflected away from the encircled ports 105. Air escaping ports 105 air reaches the internal tank space 203 (FIG. 7) to charge the aerator 20. The one-way check valve O-ring 64 prevents air in the internal tank space 203 from ever moving back into the plunger rod airway ports 105. Thus a first operational air pathway, to fill the aerator tank and charge it for a subsequent output blast, is established by inlet port 101, rod entry port 102, plunger rod airway 103, and ports 105.

C.) A second operational air pathway delivers compressed air through cavity 201 to slowly pressurize cavity 202 to a pressure less than the pressure in cavity 201. Pressured air reaching cavity 201 (FIG. 14) passes through the balance vent 106 in the actuator piston 38 and through a one-way actuator reed valve 39 to pressurize cavity 202 between the actuator piston 38 and the actuator mount flange 31. The reed valve 39 prevents air in cavity 202 from ever moving back into the actuator piston vent 106.

D.) Since the pressure in cavity 202 is slightly less than the pressure in cavity 201, the actuator piston 38 is pushed towards the actuator mount flange 31 causing the plunger rod 51 to seat the plunger sealing element 52 in the plunger seat 77 as in FIG. 13, preventing air in tank cavity 203 from exiting through the air outlet pathway 204 (i.e., FIGS. 7, 10, 11). The tank fills until the pressure equalizes in cavities 201, 202, and 203. The blast aerator is now ready to fire.

Figure 8:
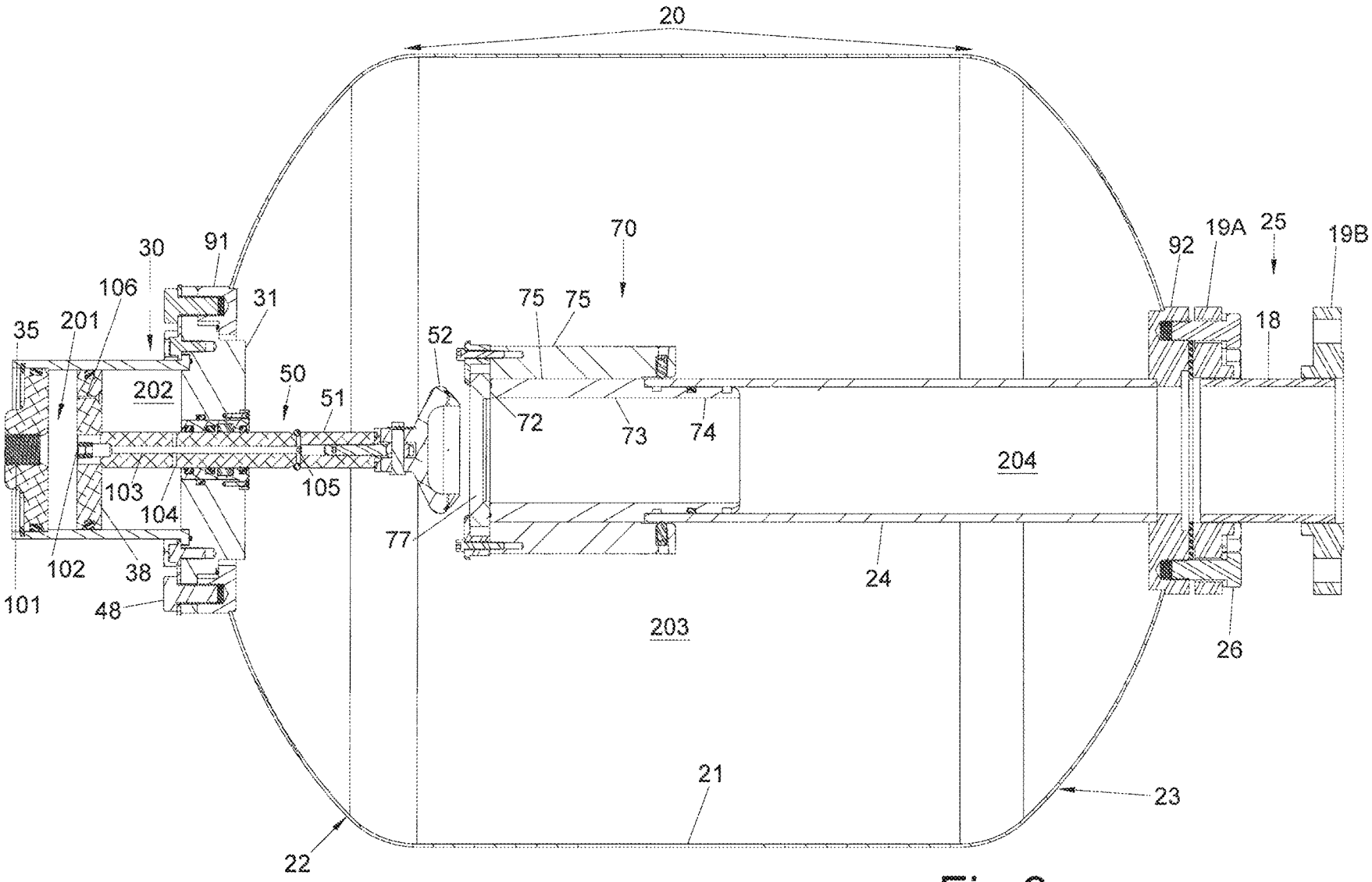
FIG. 8 is an enlarged, longitudinal sectional view similar to FIG. 7, but showing the plunger partially activated.

E.) To fire the blast aerator, the air is drawn off the air inlet port 101 and the pressure in cavity 201 drops. Since the air is held in cavity 202 by the one-way reed valve 39 and in the tank space 203 by the one-way O-ring check valve 64 blocking ports 105 and plunger rod airway 103, the pressure difference on the actuator piston 38 pushes the piston towards the actuator cap base 37 (i.e., moving to the left as viewed in FIG. 14). The movement of the actuator piston 38 causes the plunger rod 51 to pull the plunger sealing element 52 away from the plunger seat 77 as viewed in FIGS. 8 and 11. This frees pressurized tank air to escape the pressure vessel space 203 through the output tube 24 and out the air outlet pathway 204 (FIGS. 8 & 11).

As recognized by those skilled in the art, to depressurize the cavity 201, and thus fire the blast aerator, a three-way normally open solenoid valve or a three-way manual pneumatic valve may be used. The valve is normally open to the air cannon to supply air. When the valve is closed to the air supply line, the air in the air cannon (cavity 201) is connected to an exhaust port on the valve that is at atmospheric pressure allowing air to flow out of cavity 201 back through the inlet port 101 and out the exhaust port of the three-way valve. This is the primary way of dropping the pressure in cavity 201 to initiate the firing sequence.

Figure 9:
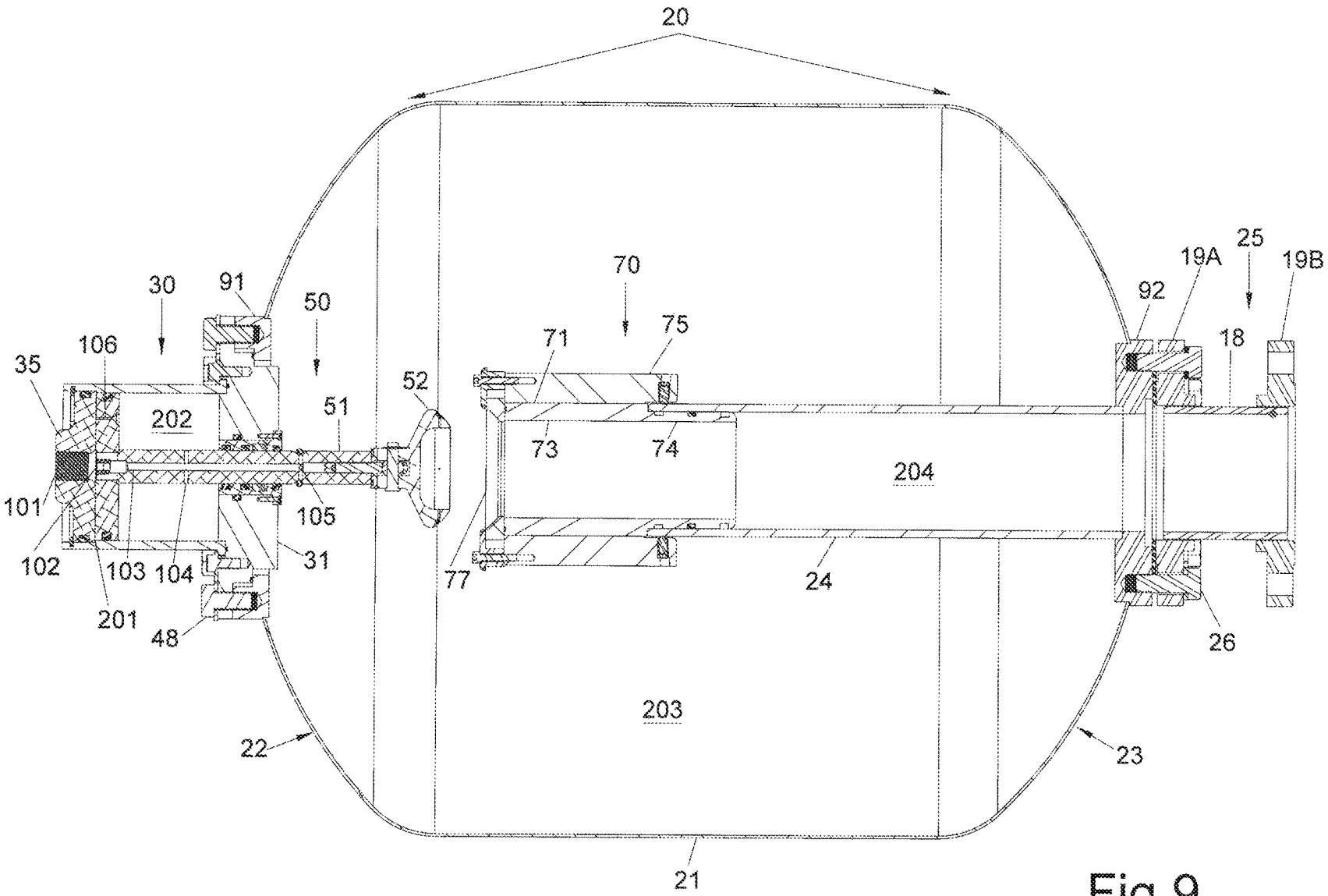
FIG. 9 is an enlarged, longitudinal sectional view similar to FIGS. 7 and 8, but showing the plunger fully opened for triggering the aerator.

F.) A third important operational air pathway controls piston retraction, i.e., travel of the actuator piston 38 towards the actuator cap base 37, and thus buffers the piston. First, as the actuator piston 38 retracts towards the actuator cap base 37 (i.e., FIG. 14) the volume in cavity 202 increases, dropping the pressure in cavity 202. As movement of the actuator piston 38 pulls the plunger rod 51 far enough, the travel control ports 104, which connect with the plunger rod airway 103, are exposed in cavity 202 (FIG. 14). This third operational air pathway allows higher pressure air in cavity 202 to move towards cavity 201 through the travel control ports 104, plunger rod airway 103, and the plunger rod entry port 102. Once the pressure in cavities 201 and 202 equalizes, movement of the actuator piston ceases and the actuator piston 38 will not impact the actuator cap base (FIGS. 9 and 12).

G.) Then the first operational air pathway prepares the aerator for a recharge. When pressure is restored at the air inlet port 101, the pressure will again build in cavity 201 causing the piston to move towards the actuator mount flange 31 causing the plunger rod 51 to close the plunger sealing element 52 against the plunger seat 77 once again (i.e., FIG. 7, 10, 13). The blast aerator 20 will refill through the plunger rod airway 103 and the plunger rod exit ports 105 as before. With the piston disposed as illustrated in FIG. 10, it will be noted that travel control port 104 in the plunger rod 51 is closed within the mounting flange 31.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blast aerator comprising:

a rigid air accumulation tank with an actuator end and a spaced-apart discharge end, the discharge end adapted to be coupled to an external discharge pipe that conducts air blasts to an application;

an internal output tube secured within the tank in fluid flow communication with said discharge pipe; and, an aerator module adapted to be retrofitted to said tank, said aerator module comprising:

an actuator for initiating air blasts from the blast aerator, the actuator comprising an inlet for connection to an external source of high pressure air and a generally tubular housing defining a cylindrical interior, an actuator cap closing one end of said actuator housing and a spaced apart mounting flange sealing the opposite end of said actuator housing;

a plunger seat adaptor assembly adapted to be coaxially coupled to said internal output tube, the plunger seat adaptor assembly comprising a seat adapted to be selectively and blocked and unblocked;

a plunger assembly controlled by said actuator and adapted to be positioned within the tank, said plunger assembly comprising a sealing element for selectively blocking and unblocking said plunger seat and a plunger rod for actuating said sealing element;

a piston coupled to said plunger rod that is slidably disposed within said actuator housing for activating and withdrawing said plunger assembly;

a first operational air pathway for pressurizing the tank, the first operational air pathway comprising an air inlet penetrating the actuator cap that conducts factory air to said actuator interior and an elongated airway defined in said plunger rod that delivers air through at least one check-valve for filling and pressurizing the tank when said sealing element is blocking said plunger seat; and, wherein depressurization of said actuator housing fires said aerator.

2. The blast aerator as defined in claim 1 wherein said piston divides said actuator housing into a first and second cavity, and said aerator comprises a second operational air pathway that conducts air through said piston from said first cavity to pressurize said second cavity at a pressure less than the pressure in said first cavity during deflection of said plunger assembly, wherein depressurization of said first cavity results in piston retraction in response to pressure from said second cavity to retract said sealing element and fire said aerator.

3. The blast aerator as defined in claim 2 further comprising a third operational air pathway for buffering the piston during travel, said third operational air pathway established by travel control ports defined in said plunger rod communicating with said plunger rod interior passageway when said travel control ports are positioned within said second cavity thereby pressurizing said first cavity to equalize cavity pressure to slow piston retraction and prevent impact damage.

4. The blast aerator as defined in claim 1 wherein said at least one check valve defined in said plunger rod is defined by a plurality of radially spaced apart exit ports communicating with said plunger rod interior passageway that may be blocked by an O-ring.

5. The blast aerator as defined in claim 4 wherein the output tube is concentrically secured within said tank.

6. The blast aerator as defined in claim 1 wherein the plunger seat adaptor assembly comprises a plunger adaptor that engages said output tube, the plunger adaptor comprising a rigid, tubular body that is coaxial and integral with a reduced diameter, terminal base portion that coaxially fits within said output tube, the tubular body portion supporting said seat.

7. The blast aerator as defined in claim 6 wherein the reduced diameter, terminal base portion comprises at least one O-ring for providing a seal between the plunger seat adaptor assembly and said output tube and at least one weldment for securing the plunger adaptor assembly to said output tube.

8. The blast aerator as defined in claim 1 wherein said plunger rod passes through a wear insert and is sealed by O-rings and a seal/wiper to prevent contaminants that enter the tank from reaching the actuator.

9. The blast aerator as defined in claim 8 further comprising a wick lubricator that lubricates the plunger rod to minimize wear and prevent heat build-up.

10. The blast aerator as defined in claim 1 further comprising a ball joint that allows the plunger sealing element to swivel several degrees in all directions to maintain correct alignment of the plunger sealing element with the seat.

11. For a blast aerator of the type comprising a rigid air accumulation tank with an actuator end, a spaced-apart discharge end, and an internal output tube secured within the tank and communicating through said discharge end, a retro-fittable aerator module adapted to be secured to said tank actuator end for repairing the aerator, said module comprising:

an actuator for initiating air blasts from the blast aerator, the actuator comprising an inlet for connection to an external source of high pressure air and a generally tubular housing defining a cylindrical interior, an actuator cap closing one end of said actuator housing and a spaced apart mounting flange sealing the opposite end of said actuator housing;

a plunger seat adaptor assembly adapted to be coaxially coupled to said internal output tube, the plunger seat adaptor assembly comprising a seat adapted to be selectively and blocked and unblocked;

a plunger assembly controlled by said actuator and adapted to be positioned within the tank, said plunger assembly comprising a sealing element for selectively blocking and unblocking said plunger seat and a plunger rod for actuating said sealing element;

a piston coupled to said plunger rod that is slidably disposed within said actuator housing for activating and withdrawing said plunger assembly;

a first operational air pathway for pressurizing the tank, the first operational air pathway comprising an air inlet penetrating the actuator cap that conducts factory air to said actuator interior and an elongated airway defined in said plunger rod that delivers air through at least one check-valve for filling and pressurizing the tank when said sealing element is blocking said plunger seat; and, wherein depressurization of said actuator housing fires said aerator.

12. The module as defined in claim 11 wherein said piston divides said actuator housing into a first and second cavity, and said aerator comprises a second operational air pathway that conducts air through said piston from said first cavity to pressurize said second cavity at a pressure less than the pressure in said first cavity during deflection of said plunger assembly, wherein depressurization of said first cavity results in piston retraction in response to pressure from said second cavity to retract said sealing element and fire said aerator.

13. The module as defined in claim 12 further comprising a third operational air pathway for buffering the piston during travel, said third operational air pathway established by travel control ports defined in said plunger rod communicating with said plunger rod interior passageway when said travel control ports are positioned within said second cavity thereby pressurizing said first cavity to equalize cavity pressure to slow piston retraction and prevent impact damage.

14. The module as defined in claim 11 wherein said at least one check valve defined in said plunger rod is defined by a plurality of radially spaced apart exit ports communicating with said plunger rod interior passageway that may be blocked by an O-ring.

15. The module as defined in claim 14 wherein the output tube is concentrically secured within said tank.

16. The module as defined in claim 11 wherein the plunger seat adaptor assembly comprises a plunger adaptor that engages said output tube, the plunger adaptor comprising a rigid, tubular body that is coaxial and integral with a reduced diameter, terminal base portion that coaxially fits within said output tube, the tubular body portion supporting said seat.

17. The module as defined in claim 16 wherein the reduced diameter, terminal base portion comprises at least one O-ring for providing a seal between the plunger seat adaptor assembly and said output tube and at least one weldment for securing the plunger adaptor assembly to said output tube.

18. The module as defined in claim 11 wherein said plunger rod passes through a wear insert and is sealed by O-rings and a seal/wiper to prevent contaminants that enter the tank from reaching the actuator.

19. The module as defined in claim 18 further comprising a wick lubricator that lubricates the plunger rod to minimize wear and prevent heat build-up.

20. The module as defined in claim 11 further comprising a ball joint that allows the plunger sealing element to swivel several degrees in all directions to maintain correct alignment of the plunger sealing element with the seat.

* * * * *